US005857700A

United States Patent [19]

Ross

[11] Patent Number: 5,857,700

[45] Date of Patent: Jan. 12, 1999

[54] QUICK-RELEASE SNOWBOARD BINDING

[76] Inventor: Gary M. Ross, 121 Santa Paula Ave., Oxnard, Calif. 93035

[21] Appl. No.: 731,976

[22] Filed: Oct. 23, 1996

Related U.S. Application Data

[60] Provisional application No. 60/006,034 Oct. 23, 1995.

[51] Int. Cl.[6] ..... A63C 9/18

[52] U.S. Cl. ..... 280/623; 280/14.2

[58] Field of Search ..... 280/607, 11.36, 280/14.2, 633, 617, 618, 623, 619, 634; 36/117, 122, 125, 120; 24/68 SK, 69 SK, 70 SK, 71 SK, 69 R

[56] References Cited

U.S. PATENT DOCUMENTS

| | | | |
|---|---|---|---|
| 324,136 | 8/1885 | Marshall et al. | 24/68 SK |
| 4,207,776 | 6/1980 | Helt et al. | 24/68 SK |
| 4,546,521 | 10/1985 | Ribarrits | 280/633 |
| 4,979,760 | 12/1990 | Derrah | 280/607 |
| 5,143,396 | 9/1992 | Shannan et al. | 280/607 |
| 5,190,311 | 3/1993 | Carpenter et al. | 280/618 |
| 5,362,087 | 11/1994 | Agid | 280/611 |
| 5,435,080 | 7/1995 | Meiselman | 36/117 |
| 5,586,367 | 12/1996 | Benoit | 24/68 SK |

FOREIGN PATENT DOCUMENTS

| | | | |
|---|---|---|---|
| 450857 | 10/1913 | France | 280/619 |
| WO 94/25125 | 11/1994 | France | 280/14.2 |

*Primary Examiner*—Brian L. Johnson
*Assistant Examiner*—Bridget Avery
*Attorney, Agent, or Firm*—Christie, Parker & Hale, LLP

[57] ABSTRACT

A snowboard binding system for a generic soft boot which provides a quick-release snowboard binding that retains a desired strap tension setting, and provides an unobstructed path for the rider's boot into and out of the binding when the binding is in a disengaged position. The snowboard binding has a base plate secured to the snowboard for accommodating a boot. First ends of a pair of adjustable straps are mounted to the base plate and the strap second ends are attached to opposed ends of a connecting rod. A rotating latch for engaging a bar is mounted to the connecting rod. The bar is attached to the side of the base plate opposite the straps. The binding is secured by engaging the bar with the latch, and rotating the latch in one motion into a secured position. The binding is disengaged by rotating the latch in the opposite direction. The straps comprise a strip of material with a spring memory and are mounted to the base plate such that, when disengaged, they do not obstruct the movement of a rider's boot into or out of the binding.

13 Claims, 10 Drawing Sheets

68
72
82
70
β
80
74
66
76
78

QUICK-RELEASE SNOWBOARD BINDING

CROSS-REFERENCE TO RELATED APPLICATION

This application claims the benefit of provisional patent application Ser. No. 60/006,034 filed Oct. 23, 1995.

FIELD OF THE INVENTION

The present invention relates generally to snowboards and more particularly to a quick-release snowboard binding which retains a preferred strap tension setting in the binding and provides substantially unobstructed entry and egress of a boot.

BACKGROUND OF THE INVENTION

Snowboarding is a popular snow sport in which a rider, or snowboarder, rides a single board across a snow covered terrain. The rider secures both feet into bindings attached to the upper surface of the snowboard, improving the rider's control of the snowboard and preventing the snowboard from sliding away from the rider in a fall.

By securing both feet to the board in this manner, snowboarders severely limit their ability to propel themselves forward on level terrain. Unlike skiers, snowboarders do not use poles and cannot propel themselves by planting one ski and then pushing off with the other as is possible with individual skis. Therefore, a rider must disengage at least one foot to propel himself forward. Usually this is done by disengaging the rear foot and using it to push the snowboard forward, similar to the operation of a skateboard. Since this practice of disengaging a foot must be repeated after every run, it is desirable to have a fast and simple means for securing and releasing at least one foot from the snowboard binding.

There are two types of foot wear used for snowboarding—hard boots and soft boots. Hard boots are rigid and evolved from ski boots. They include ridge portions extending from the toe and heel which clip into plate bindings. Such plate bindings accept only boots specifically designed for them.

Soft boots are generally preferred by snowboarders as they are more comfortable than hard boots and provide a greater range of motion in the ankles, which aids in steering the snowboard. Furthermore, most soft boots have a generic design making them compatible with the most common type of soft boot binding systems. Such binding systems consist of two adjustable straps which are tightened over the foot portion of the boot to secure the rider's boots to the board. These adjustable straps have two parts, one strap portion having a ratcheted surface and the other a corresponding pawl mechanism mounted to its top surface. The ratcheted portion is slid into the pawl mechanism until a desired strap tension is achieved. When a rider wishes to remove a foot from the binding, he must disengage both straps. This entails completely separating the two portions of each strap. In addition to being a tedious task, the rider necessarily loses the desired setting for strap tension. Furthermore, when the straps are disengaged, the separated portions of the strap tend to hang limply over the area of the binding where the rider places his boot. This obstructs entry and egress of the boot into, and out of the binding.

One advantage of snowboard binding systems for hard boots is that they are easily engaged and disengaged. A rider with a hard boot can simply engage the binding by inserting the ridge portion extending from the toe of the boot into a front portion of the plate binding and then pushing down at the heel. This causes the ridge portion at the heel of the boot to engage a retracting latching mechanism. The hard boot binding is disengaged simply by pulling up at the heel of the boot.

There are also quick-release binding systems for soft boots, but these require a boot specific to the particular binding system. This limits the rider's ability to use snowboards with different bindings. Also, soft boots designed for use with such binding systems include hardware on the bottom of the boot which can be adversely affected by dirt, mud, or other debris.

Accordingly, one object of the invention is to provide an improved quick-release snowboard binding system for a generic soft boot which allows the rider to maintain his tension settings in the binding.

A further object of the invention is to provide an improved snowboard binding system which provides substantially unobstructed entry and egress of a boot.

SUMMARY OF THE INVENTION

According to the present invention, the foregoing and other objects and advantages are attained by providing a snowboard binding comprising a base plate having a surface for accommodating a boot attached to top surface of a snowboard. One or more straps are attached at one end to one side of the base plate. Preferably, these straps are adjustable. The other end of the straps are attached to a connecting rod, as is a latch, which rotates about the connecting rod. A bar for engagement by the latch is attached to the side of the base plate opposite the straps. The latch includes a hook portion for engaging the bar and a trough portion for containing the bar. Means are provided for restricting the rotation of the latch past a secured position.

In accordance with one aspect of the invention, the bar comprises a substantially U-shaped portion for engagement by the latch which is set off from the binding by two arms attached to, and extending away from the base plate.

As another aspect, the binding system comprises two straps, each having one end attached to either end of the connecting rod. The connecting rod comprises a curved rod including a mounting portion, for rotatably mounting the latch, located between two curved offset portions. The offsets engage the bar and restrict the rotation of the latch past the secured position.

In yet another aspect of the invention, the straps comprise a resilient material that maintains the assembly comprising the straps, connecting bar, and latch in a position substantially off and away from the boot entry area. Preferably, the straps comprise a thin plate of sheet metal encased in a rubber sleeve. The strap portion is compliant enough to bend over the rider's boot when the binding is secured, but is biased in a direction away from the boot housing of the binding. Thus, when the strap assembly is disengaged, it springs into a position off and away from the rider's boot, providing the rider substantially unobstructed access into or out of the binding.

To operate the snowboard binding according to the present invention, the straps are pulled across the top portion of the boot into a first, engaged, position wherein the hook portion of the latch engages the bar. The rider pulls the handle of the latch, rotating the latch in one simple motion into a second, secured, position, thereby securing the rider's boot in the snowboard binding. The rider may just as easily disengage the binding by rotating the latch handle in the opposite direction, which moves the latch from the secured position to the engaged position, and then pulls the latch off of the bar.

The invention, using a strap assembly connecting the straps to a single, rotatable latch, thus provides a quick-release snowboard binding system for a generic soft boot. Furthermore, the invention provides unobstructed access of a rider's boot to the snowboard binding when in a disengaged position.

BRIEF DESCRIPTION OF THE DRAWINGS

These and other features of the invention will become apparent in the following detailed description of a presently preferred embodiment taken in conjunction with the accompanying drawings, wherein.

DETAILED DESCRIPTION

Figure 1:
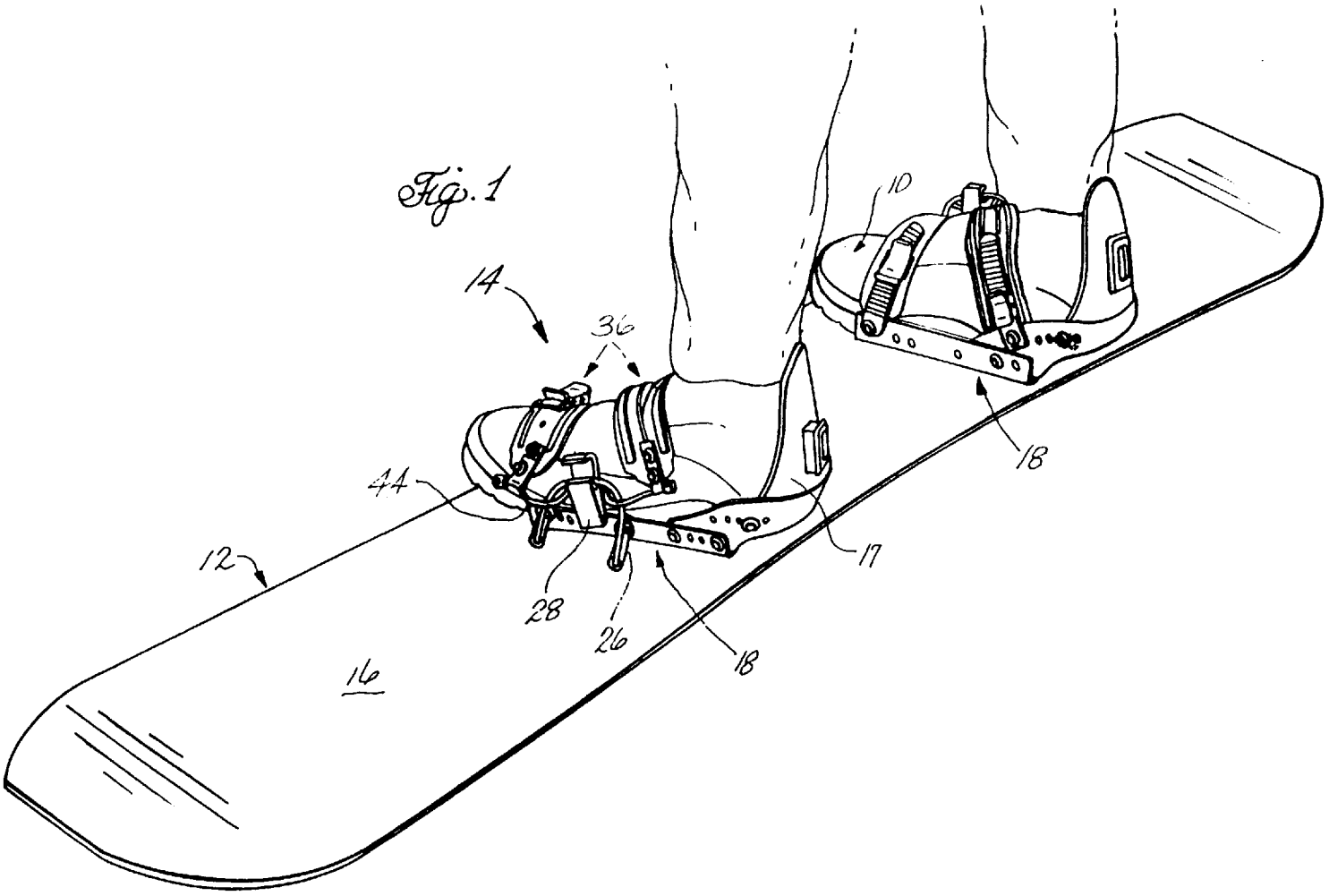
FIG. 1 is a perspective view of the snowboard binding system.

Referring to FIG. 1, a preferred embodiment of a snowboard binding, according to the invention, is used to secure the feet of a rider wearing soft boots 10 to a snowboard 12. A pair of spaced-apart snowboard bindings 14 for accommodating the rider's boots are mounted to the top surface 16 of the snowboard. A heel plate 17 is also provided for added support at the back of the rider's boots.

Figure 2:
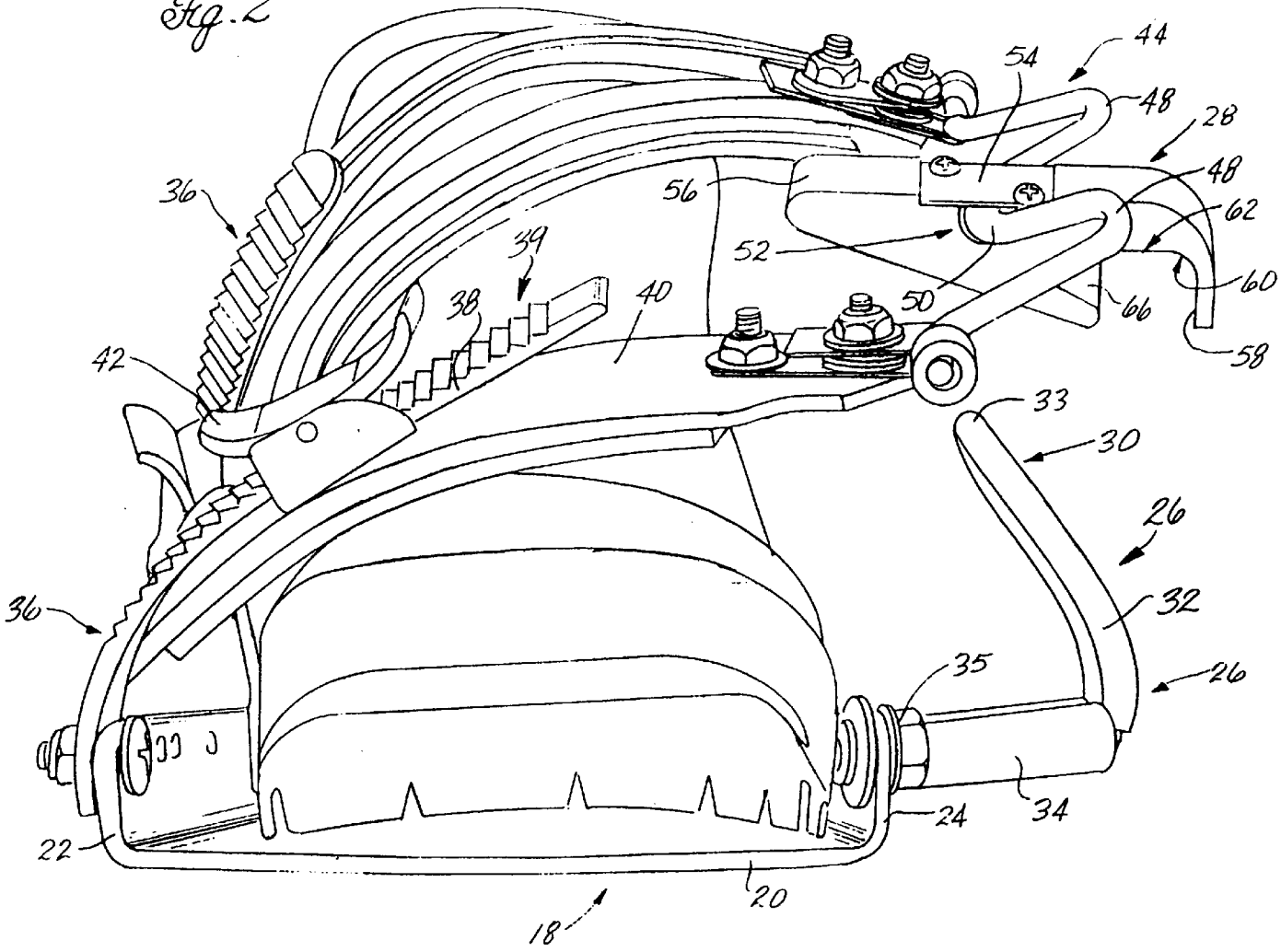
FIG. 2 is a front view of the binding in the disengaged position.

FIG. 2 is a front view of an unlatched snowboard binding 14 which includes a base plate 18 mounted to the top surface 16 of the snowboard. The base plate comprises a bottom plate 20 shaped to accommodate to the rider's boot, which acts as a housing for the boot in the binding. The base plate also has an outer raised side wall 22 corresponding to the outer edge of the rider's foot, and an inner raised side wall 24, corresponding to the instep of the rider's foot. A curved bar 26 for engaging a rotating latch 28 is bolted at both ends to outer sidewall 22. The bar consists of a cylindrical steel bar having a U-shaped portion 30 (best seen in FIG. 3) extending up and in towards the binding. The U-shaped portion includes two legs 32 and a latching portion 33 for engaging the latch 28. The bar also includes two arms 34 attached by threaded fasteners 35 to outer side wall 22 which extends the U-shaped portion one to three inches laterally away from the base plate. Setting the latching portion away from the binding in this manner provides the latch room to travel during its rotation.

Two adjustable straps 36 are attached to inner side wall 22. The straps are positioned so that they may be secured over the top foot portion of the boot. Each strap includes two parts, one portion 38 having a ratcheted surface 39 and the other 40 having a corresponding pawl mechanism 42. One end of each strap is bolted to the base plate, and the other end is connected to one end of a curved connecting rod 44 by a bushing 46. The connecting rod is a steel rod comprising two offsets or bends 48 which accommodate legs 32 of U-shaped portion of bar 26 when the binding is in a secured position (see FIGS. 3 and 4). Preferably, the bushings 46 maintain the offsets 48 of the connecting rod in a generally horizontal plane.

The latch 28 is made of a hard material, for example, stainless steel or injection molded plastic, which is rotatably mounted to the connecting rod 44 at a mounting portion 50 located between the two offsets 48. In a preferred embodiment, the latch is mounted to the connecting rod by positioning the center mounting portion of the connecting rod into a recess 52 in the back surface of the latch, and then securing a metal plate 54 to the back surface of the latch over the connecting rod.

Figure 5:
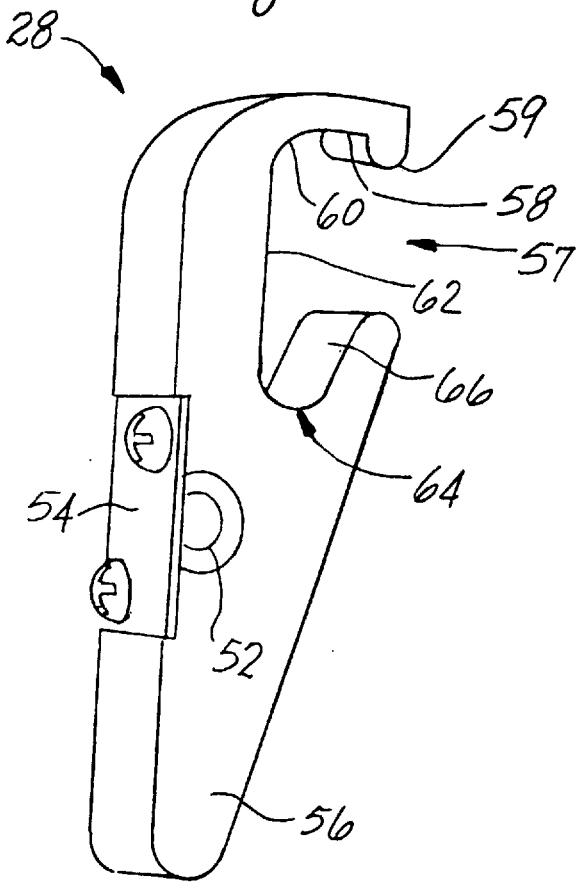
FIG. 5 is a perspective view of the latch.

FIG. 5 is a perspective view of latch 28. The latch has a latch mouth 57 with a surface for contacting the bar. Latch mouth 57 includes a hook portion 58 connected to a bend 60 which in turn is connected to one end of a flat portion 62. A trough portion 64 is located between the other end of flat portion 62 and a wall portion 66.

To secure the binding, the rider merely engages the bar with the latch and then uses the latch handle 56 to rotate the latch 28 about the connecting rod 44 until the latch is in the secured position. Due to the geometry of latch mouth 57, the latch will "snap" into this secured position.

More particularly, to operate the snowboard binding according to the invention, the rider first places a boot onto the bottom portion 20 of the base plate 18. The rider then pulls the straps 36 across the top portion of the boot and engages the latch with the center of the U-shaped portion 30 of the bar.

Figure 6:
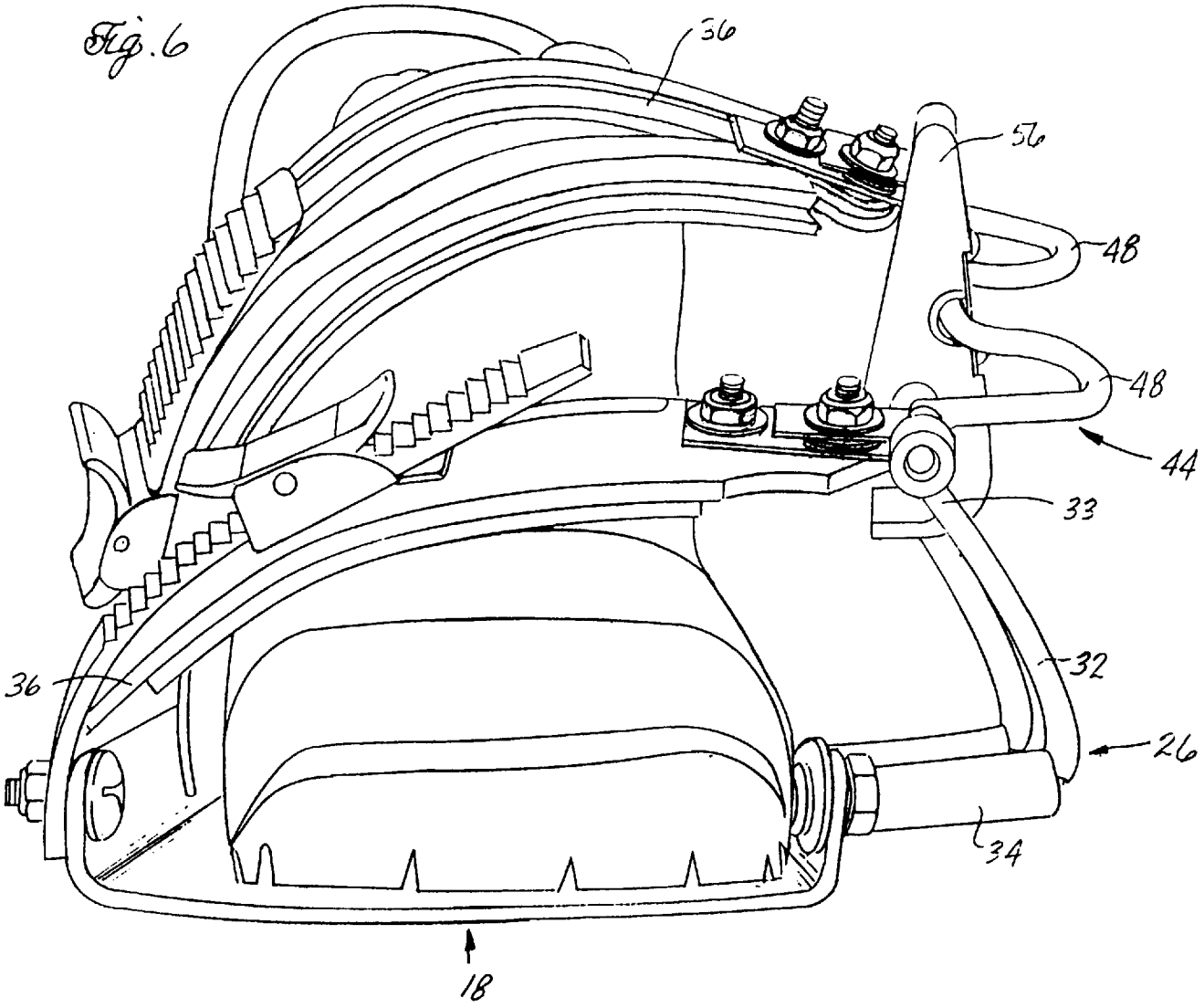
FIG. 6 is a front view of the binding in the engaged position.

FIG. 6 shows the binding in the first engaged position, wherein the bar is engaged by a hook portion 58. As the latch is rotated (clockwise as seen in FIG. 6), bar 26 slides into bend 60. The bar then slides across flat portion 62 into trough portion 64, where it is contained throughout the rest of the rotation by flat portion 62 and wall portion 66.

During rotation, bar 26 exerts pressure onto the surface of the latch it is contacting in a direction normal to that surface. The latch also experiences pressure from connecting rod 44 due to tension exerted on the rod by the straps 36. The force exerted by the connecting rod onto the latch is also normal to the latch surface it contacts, i.e., recess 52 or metal plate 54. The rider must exert force on the handle during the first portion of the rotation to overcome the tension exerted by the straps. At one point the force exerted by connecting rod 44 on the latch will be equivalent in magnitude and opposite in direction to the force exerted by bar 26 on the latch. At this point, the latch is in equilibrium.

Figure 3:
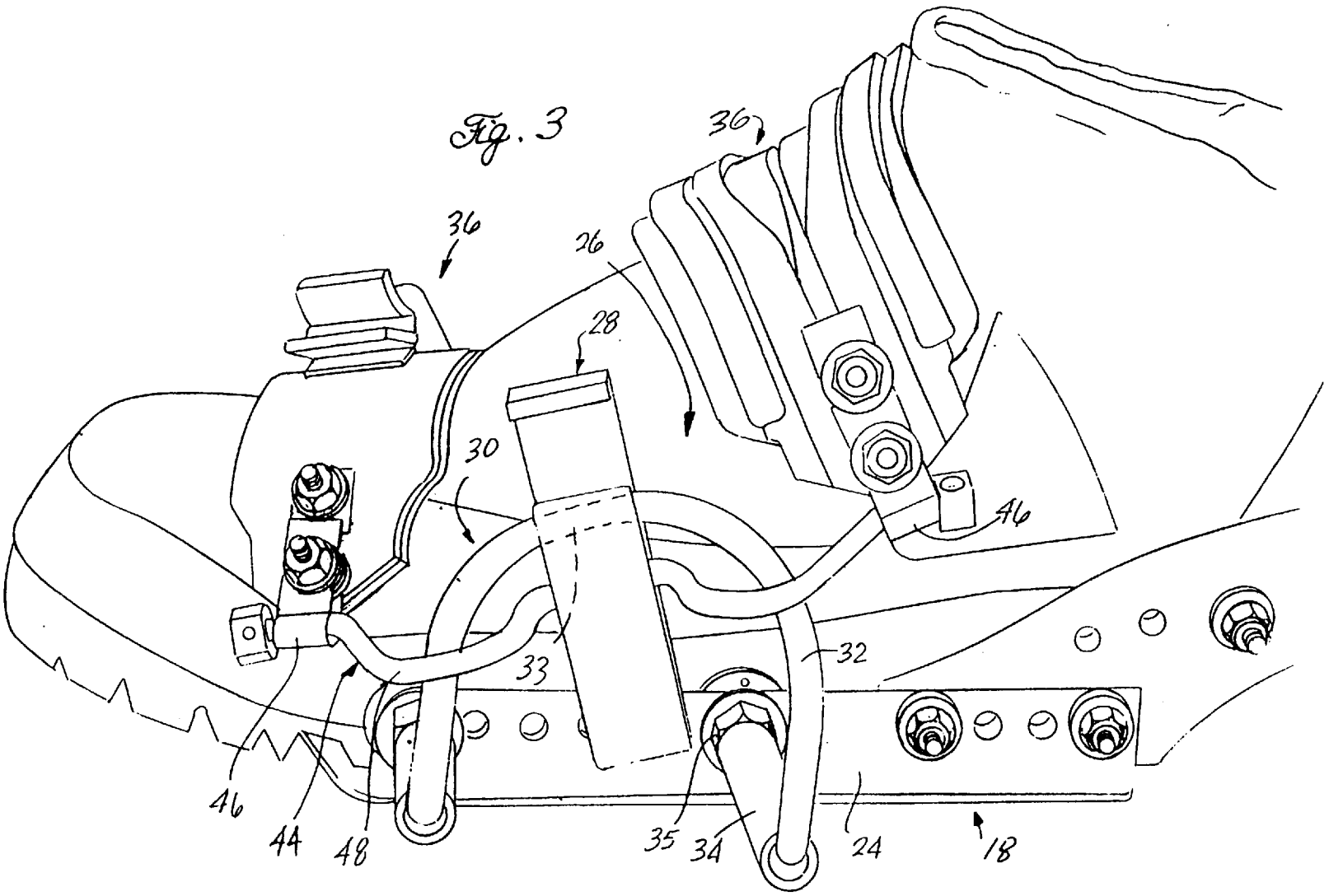
FIG. 3 is a side view of the binding in the secured position.
Figure 4:
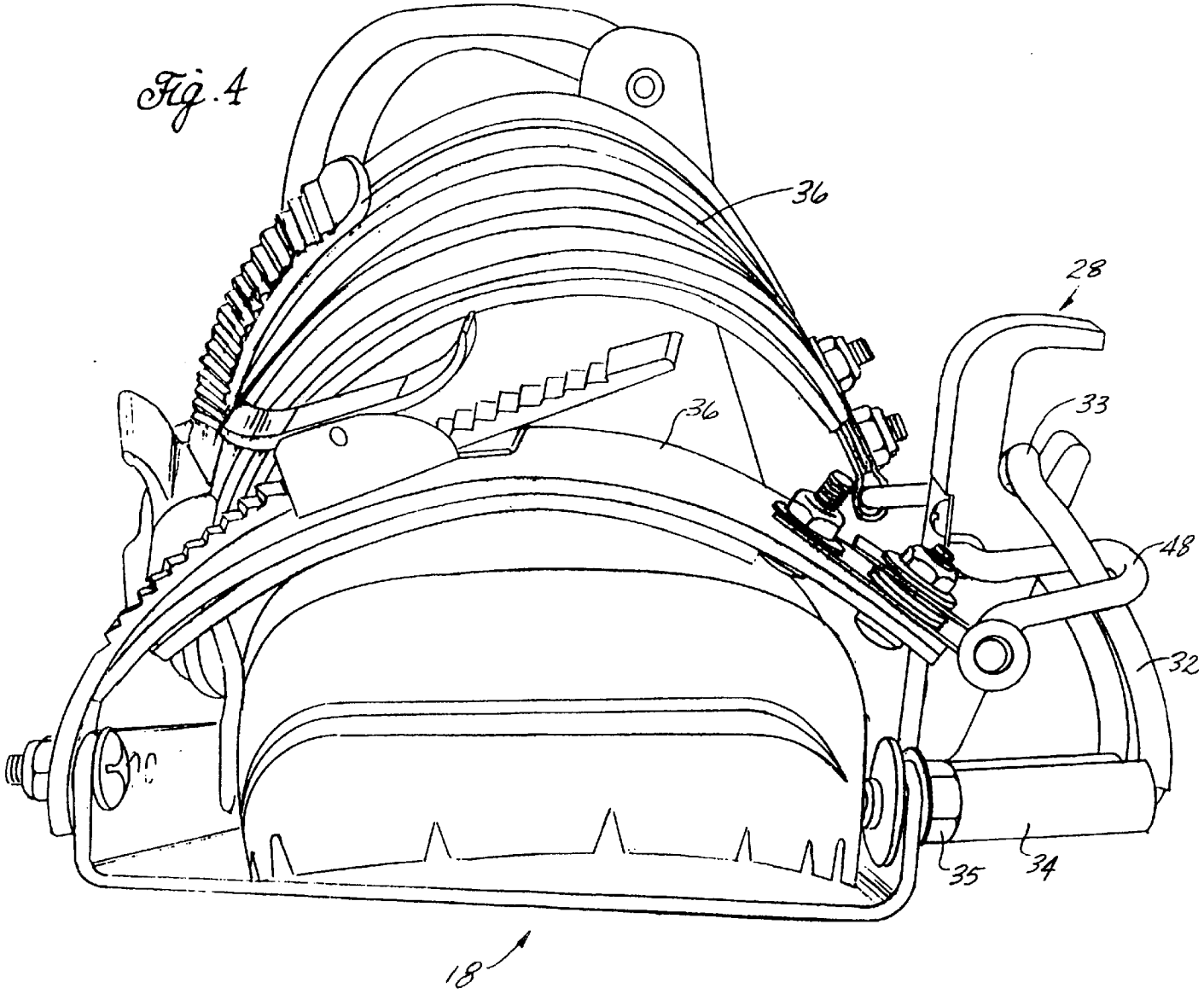
FIG. 4 is a front view of the binding in the secured position.

Once the rider rotates the latch beyond this equilibrium point, the forces exerted by the bar and by the connecting rod will cause the latch to continue to rotate automatically. The extending arms of the bar provide the latch enough clearance to rotate about latching portion 33 of the bar into the fully secured position (FIG. 3 and 4). Offsets 48 prevent the latch from rotating past the secured position by engaging the legs of the U-shaped portion of the bar. Thus, once the rider rotates the handle past the equilibrium point, the latch will snap into the secured position.

To disengage the latch, the rider simply rotates the handle in the opposite direction. Upon passing the equilibrium point, the latch will snap into either the initial engaged position (FIG. 6), or if the tension in the straps is great enough, into a completely disengaged position (FIG. 2).

Upon initial use of the snowboard binding of the present invention, the rider adjusts the straps to a desired tension setting while the binding is in the secured position. This tension setting will be maintained after the binding is disengaged and the same tension will be repeated when the rider re-secures the binding.

Figure 7:
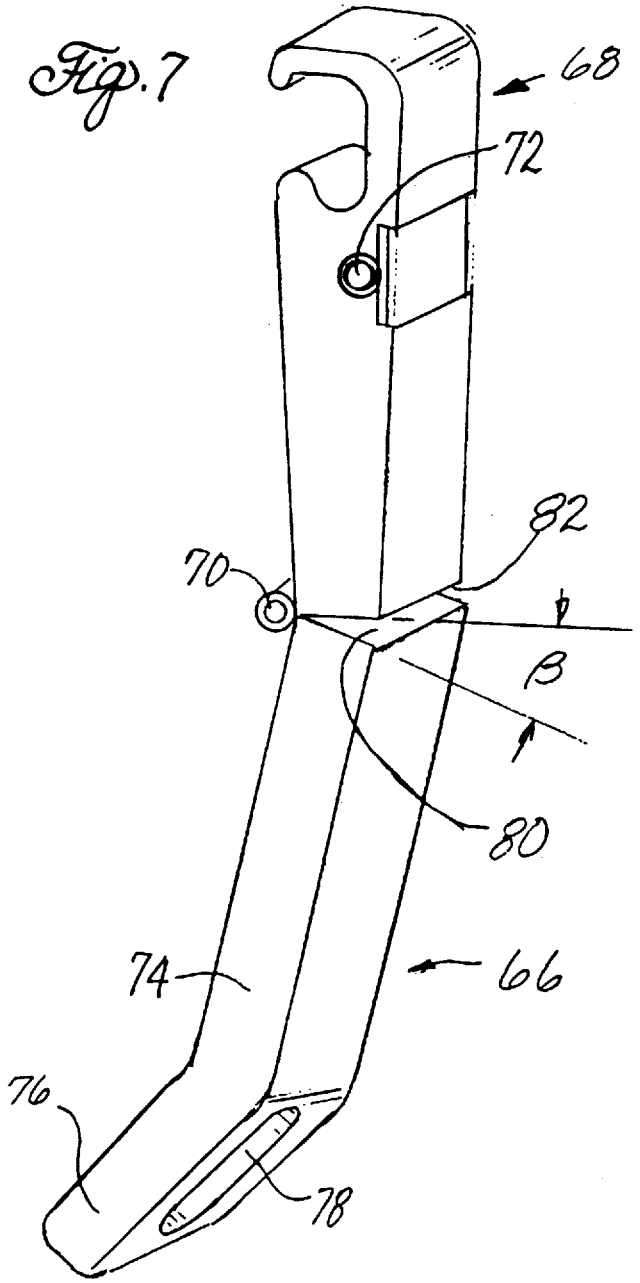
FIG. 7 is a perspective view of the latch having a long handle.

Snowboarding is a snow sport, and as such, many snowboarders wear gloves which can decrease their dexterity. FIG. 7 illustrates one embodiment of the present invention which provides a long handle 66 to facilitate gripping and to provide a longer lever arm during rotation of the latch. The long handle is preferably made of stainless steel, injection molded plastic, or other durable material. The handle is separate from latch body 68, but is attached to the latch by a hinge 70 located on the side of the latch opposite the rotatable mount 72. The handle includes a lever arm 74 and a grip portion 76. A finger hole 78 may be provided in the grip portion to allow operation by a single finger.

Figure 8:
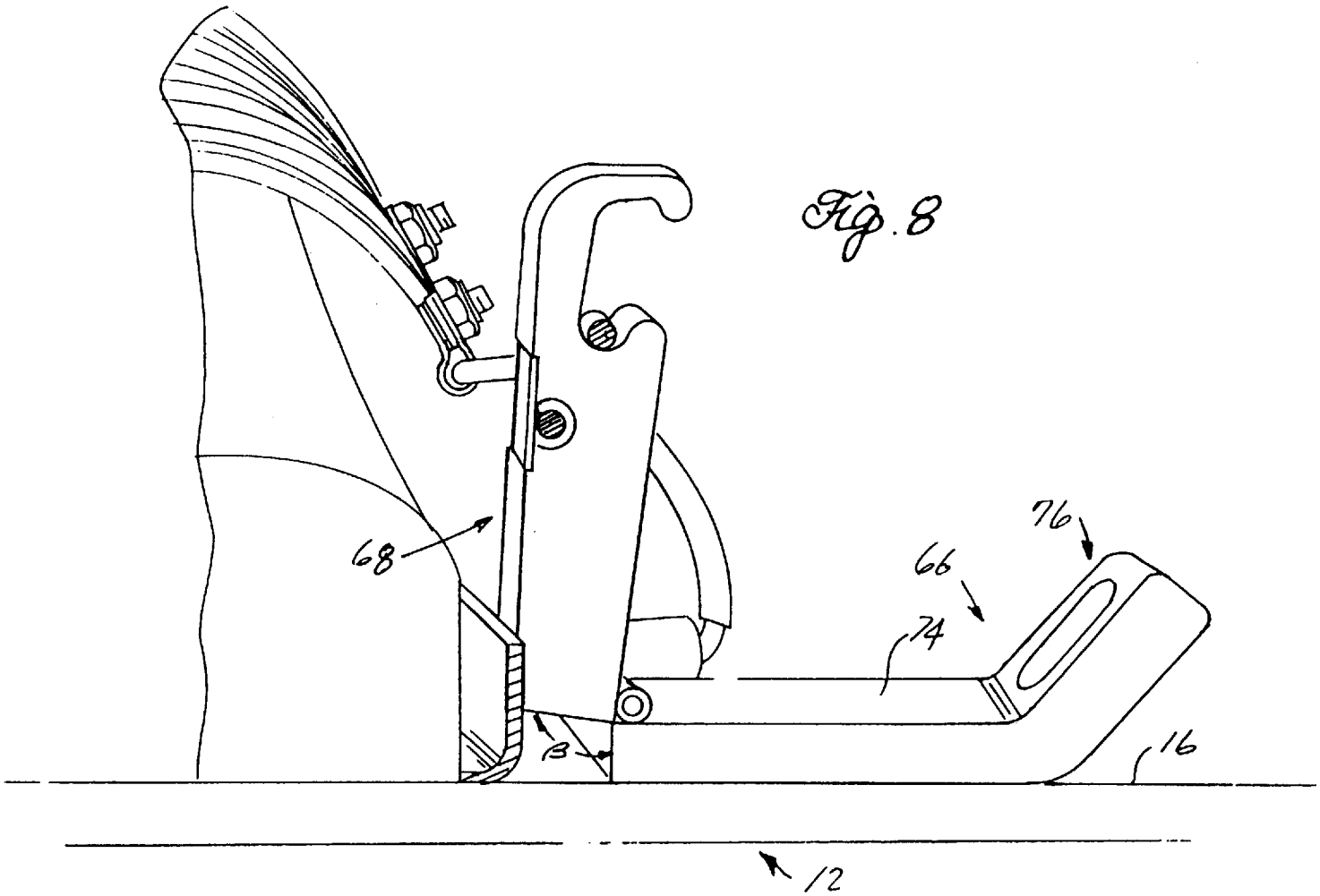
FIG. 8 is a side view of a snowboard binding system including the long handled latch in the secured position.

While the rider is pulling against the handle to rotate the latch into the secured position, front face 80 of the handle is flush with rear face 82 of the latch body, and the hinge angle, β, equals 0°. When the latch snaps into position, lever arm 64 falls flush against the top surface of the snowboard, and hinge angle β approaches a maximum hinge angle of about 90° (FIG. 8). Grip portion 76 is bent at an angle from the plane of lever arm 74, making it more accessible to the rider. To disengage the binding, the rider grasps grip portion 76 and pulls up and away from the board. When β reaches the maximum hinge angle, hinge 70 is restricted, and latch body 68 begins to rotate. The rider pulls until the latch snaps into the engaged position and continues pulling until the latch is completely disengaged.

Figure 9:
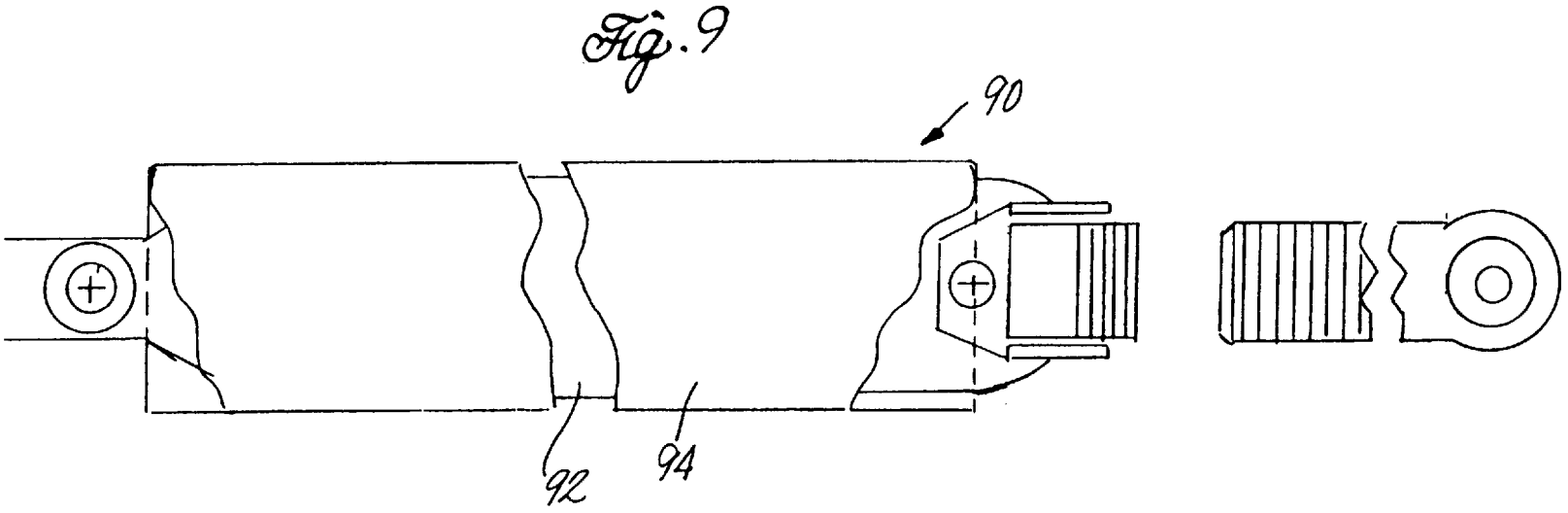
FIG. 9 is a partial, cut-away top view of the resilient strap.
Figure 10:
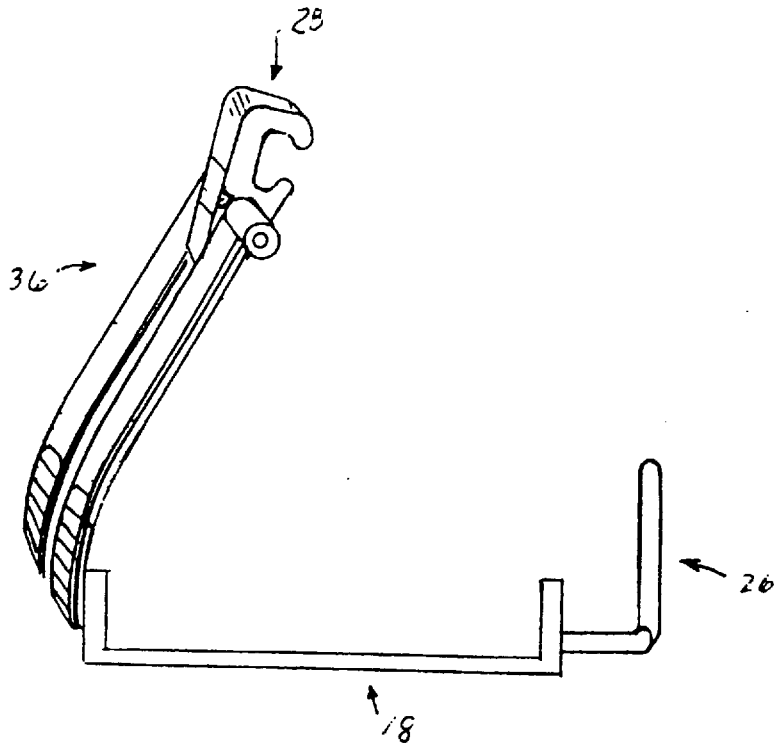
FIG. 10 is a front view of the binding including resilient straps in the disengaged position.

In another embodiment of the invention, the strap includes a strip of material with a spring memory. The strap is biased off and away from the base plate to provide the rider with substantially unobstructed access when placing his boot in, or removing his boot from the snowboard binding, as shown in FIG. 6. In a preferred embodiment, illustrated in FIG. 9, strap portion 90, which includes the pawl mechanism, comprises a thin plate 92 of stainless steel or other resilient material coated in a sleeve 94 of synthetic rubber. This strap has a spring memory causing it to return to a substantially flat plane when the latch is disengaged from the latch bar. Thus, when the latch is disengaged, the strap portion is positioned substantially off and away from base plate 18, as shown in FIG. 10, providing the rider improved access to the binding. However, the strap portion is compliant enough to be bent across the rider's boot and the latch engaged into a secured position without excessive resistance.

While a preferred embodiment of the invention has been illustrated and described, it should be understood that variations will be apparent to those skilled in the art. For example, the snowboard binding may include just one adjustable strap with a forked end for attachment to both ends of connector rod. Conversely, several straps may be attached to either end of the connector rod. Furthermore, rotating latches with geometries other than those illustrated may be utilized in the binding according to the present invention. Accordingly, the invention is not to be limited to the specific embodiments illustrated and described, but should be determined by reference to the following claims.

What is claimed is:

1. A snowboard boot binding for use with a snowboard comprising:

a strap having a first end and a second end;

a bar having an area for latching;

mounting means attached to the first strap end adapted to secure the first strap end to the snowboard, and adapted to fixedly secure the bar to the snowboard in a position spaced apart from the first strap end;

a latch adapted to selectively engage the area for latching on the bar;

a connecting rod, wherein the second strap end is attached to the connecting rod and the latch is rotatably mounted to the connecting rod; and means for restricting the rotation of the latch past a secured position.

2. The snowboard boot binding of claim 1 wherein the mounting means comprises a base plate for accommodating a boot.

3. The snowboard boot binding of claim 1 wherein the strap is adjustable.

4. The snowboard boot binding of claim 3 further comprising one or more straps, each having a first end and a second end, wherein each first strap end is attached to the mounting means and each second strap end is attached to the connecting rod.

5. The snowboard boot binding of claim 1 wherein the bar comprises a substantially U-shaped portion comprising the area for latching and a pair of arms, wherein the area for latching on the bar is located between the pair of arms.

6. The snowboard boot binding of claim 5 wherein the latch and the connecting rod are separate elements, wherein the connecting rod comprises a curved rod having two offset portions adapted to selectively engage the arms of the bar and a mounting portion upon which the latch is rotatably mounted, and wherein the mounting portion is located between the two offset portions.

7. The snowboard binding of claim 6 wherein the offset portions of the connecting rod and the arms of the bar comprise the means for restricting the rotation of the latch.

8. The snowboard boot binding of claim 1 wherein the latch comprises a hook portion for engaging the area for latching on the bar and a trough portion for containing said area for latching in an engaged position.

9. The snowboard boot binding of claim 1 wherein the latch comprises a latch body connected to a long handle.

10. A snowboard boot binding for use with a snowboard comprising:

a strap having a first end and a second end;

a bar having an area for latching;

mounting means attached to the first strap end for securing the first strap end to the snowboard, and for securing the bar to the snowboard in a position spaced apart from the first strap end;

a latch for selectively engaging the area for latching on the bar;

a connecting rod, wherein the second strap end is attached to the connecting rod and the latch is rotatable mounted to the connecting rod; and means for restricting the rotation of the latch past a secured position, wherein the latch comprises a latch body connected to a long handle, and wherein the latch further comprises a hinge connecting the latch body and the long handle, wherein the hinge has a maximum hinge angle.

11. The snowboard boot binding of claim 10 wherein the maximum hinge angle is about 90°.

12. The snowboard boot binding of claim 9 wherein the long handle comprises a lever arm and a grip portion.

13. The snowboard boot binding of claim 12 wherein the grip portion comprises a finger hole.

* * * * *